US005297491A

United States Patent [19]

Sippel et al.

[11] Patent Number: 5,297,491

[45] Date of Patent: Mar. 29, 1994

[54] CASING BOTTOM FOR A PROPELLING CHARGE CASING

[75] Inventors: Achim Sippel; Heinz-Josef Kruse, both of Ratingen; Gisbert Bartsch, Halle in Westfalen; Monika Wildau, Korschenbroich; Jürgen Meyer, Köln, all of Fed. Rep. of Germany

[73] Assignee: Rheinmetall GmbH, Düsseldorf, Fed. Rep. of Germany

[21] Appl. No.: 947,399

[22] Filed: Sep. 21, 1992

[30] Foreign Application Priority Data

Sep. 20, 1991 [DE] Fed. Rep. of Germany ..... 4131286

[51] Int. Cl.[5] ..... F42B 5/28

[52] U.S. Cl. ..... 102/469; 102/430; 102/464

[58] Field of Search ..... 102/430, 464–472, 102/431, 433, 434; 89/26

[56] References Cited

U.S. PATENT DOCUMENTS

| | | | |
|---|---|---|---|
| 120,990 | 11/1871 | Metcalfe | 102/469 |
| 602,875 | 4/1898 | Ross | 102/464 |
| 1,081,983 | 12/1913 | Pedersen | 102/469 |
| 1,103,202 | 4/1914 | Hoagland . | |
| 1,605,655 | 11/1926 | Du Pont | 102/466 |
| 2,117,885 | 5/1938 | Hasek | 102/470 |
| 3,577,922 | 5/1971 | Zehfeld et al. | 102/472 |
| 3,760,729 | 9/1973 | Freeman | 102/466 |
| 4,041,868 | 8/1977 | Rayle et al. | 102/468 |
| 4,986,186 | 1/1991 | LaRocca et al. | 102/464 |

FOREIGN PATENT DOCUMENTS

| | | | |
|---|---|---|---|
| 73192 | 4/1893 | Fed. Rep. of Germany . | |
| 87332 | 6/1896 | Fed. Rep. of Germany | 102/469 |
| 300134 | 1/1920 | Fed. Rep. of Germany . | |
| 303230 | 4/1920 | Fed. Rep. of Germany . | |
| 3837839A1 | 6/1989 | Fed. Rep. of Germany . | |
| 562225 | 11/1923 | France . | |
| 337426 | 5/1969 | Switzerland . | |
| 1167 | 11/1888 | United Kingdom | 102/470 |

*Primary Examiner*—Harold J. Tudor
*Attorney, Agent, or Firm*—Spencer, Frank & Schneider

[57] ABSTRACT

A casing bottom or stub casing for a propelling charge casing whose base plate (1) has an exterior or outer surface which is curved inwardly in an annular region (7) so that the casing bottom is able to sufficiently axially expand under the high gas pressure developing during firing without requiring the use of a high strength material.

2 Claims, 1 Drawing Sheet

CASING BOTTOM FOR A PROPELLING CHARGE CASING

BACKGROUND OF THE INVENTION

The present invention relates to a casing bottom for a propelling charge casing. More particularly, the present invention relates to such a casing bottom which has a circular ring-shaped (annular) base plate provided with a centrally arranged primer sleeve for accommodating a primer element and with a cylindrical section at the outer edge of the base plate and formed in one piece with the base plate.

Propelling charge casings are usually provided with a casing bottom that has a planar base plate and, in large-caliber ammunition, for example, for armored weapons, is composed of high strength steel because of the high gas pressures occurring upon firing (approximately 7000 bar for 120 caliber and about 8000 bar for 140 caliber ammunition). The forged casing bottom blank is given a machining pretreatment, is then further tempered by a special heat treatment and finally machined again. Then it is surface treated in order to ensure corrosion protection and finally a rubber sealing lip is vulcanized on. This is a very expensive manufacturing process.

SUMMARY OF THE INVENTION

It is therefore an object of the present invention to provide a casing bottom of the general type described above which can be manufactured more economically.

The above object is generally achieved according to the present invention by a casing bottom for a propelling charge casing which bottom includes a circular ring-shaped base plate provided with a centrally arranged primer sleeve for accommodating a primer element, and with a cylindrical section at an outer edge thereof, with the sleeve and the cylindrical section being formed in one piece with the base plate, and wherein the exterior face of the base plate is inwardly curves in an annular region concentric with and around the sleeve.

According to features of the invention, the interior face of the base plate in the annular region may be planar or may be outwardly curved (convex), preferably with the same curvature as that of the exterior face.

Due to the fact that the base plate of the casing bottom of the propelling charge casing is given an inwardly curved configuration in an annular region at least on its exterior face, the casing bottom is able to increasingly axially expand in the region of the curvature when the gas pressure rises during firing until the region of curvature finally comes to lie against the breechblock wedge of the gun. Accordingly, the radius of curvature of the curved portion is selected in such a way that, in particular, pressing the curvature flat leads to radial expansion of the casing bottom by the maximum widening to be expected. The connected radial and tangential displacement of material in the casing bottom produces a radial support for the casing bottom against the gun barrel already at relatively low gas pressures (for 120 caliber ammunition, for example, the basing bottom must expand radially, in the most unfavorable case, by about 0.8 mm to be supported by the gun barrel). Therefore, the tangential tensile stresses developing in the curved casing bottom are noticeably lower than in a planar casing bottom and thus permit a corresponding reduction in material strength and elimination of manufacturing processes (for example, subsequent tempering) resulting in less expensive and more economical manufacture. Additionally, the operational reliability during firing is increased by improved gas tightness.

The invention will be described below in greater detail with reference to embodiments thereof that are illustrated in the attached drawings.

DETAILED DESCRIPTION OF THE PREFERRED EMBODIMENTS

Figure 1:
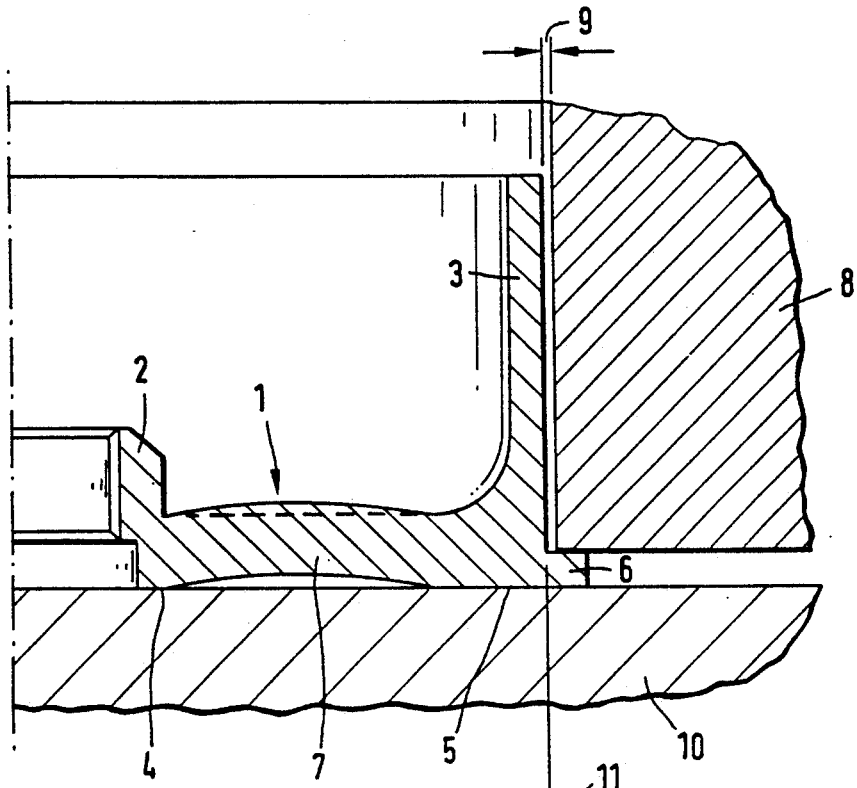
FIG. 1 is a partial sectional view of embodiments of a casing bottom for a propelling charge casing in the barrel of a loaded gun.

The rotationally symmetrical casing bottom of FIG. 1 in the form of a stub casing that is drawn in solid lines includes a base plate 1 provided with a centrally arranged primer sleeve 2, that is made in one piece with the base plate 1, for accommodating a primer element (not shown), as well as an outer cylindrical section 3, also made in one piece with base plate 1. The outer cylindrical section 3 usually contains an essentially cylindrical casing section provided with a casing opening at the front to accommodate a projectile body—not shown.

The circular, ring shaped base plate 1 is provided at its exterior face with an annular inner contact face portion 4 which surrounds primer sleeve 2 and with an outer annular contact face portion 5 which extends to a collar 6 on base plate 1 that projects radially outwardly beyond the outer surface of section 3.

In an annular region 7 of base plate 1 between the two annular planar contact face portions 4 and 5, the exterior face of base plate 1 is curved inwardly (concave). According to the embodiment shown in solid lines, the interior face of base plate 1 in the region 7 is curved outwardly (convex) with a curvature equal to that of the exterior face. Alternatively, according to the embodiment shown in dashed lines, the region 7 is curved only on the exterior face of base plate 1 i.e., the interior face in region 7 remains planar.

As shown in FIG. 1, in the loaded state in which collar 6 lies against the rear face of the barrel 8 of a gun of a caliber corresponding to that of the casing bottom, a play 9 exists between the outer surface of cylindrical section 3 (and of the connected, non-illustrated casing section of the propelling charge casing) and the wall of the gun barrel 8, while the annular contact face portions 4 and 5 of base plate 1 are supported by the breechblock wedge 10 of the gun.

Figure 2:
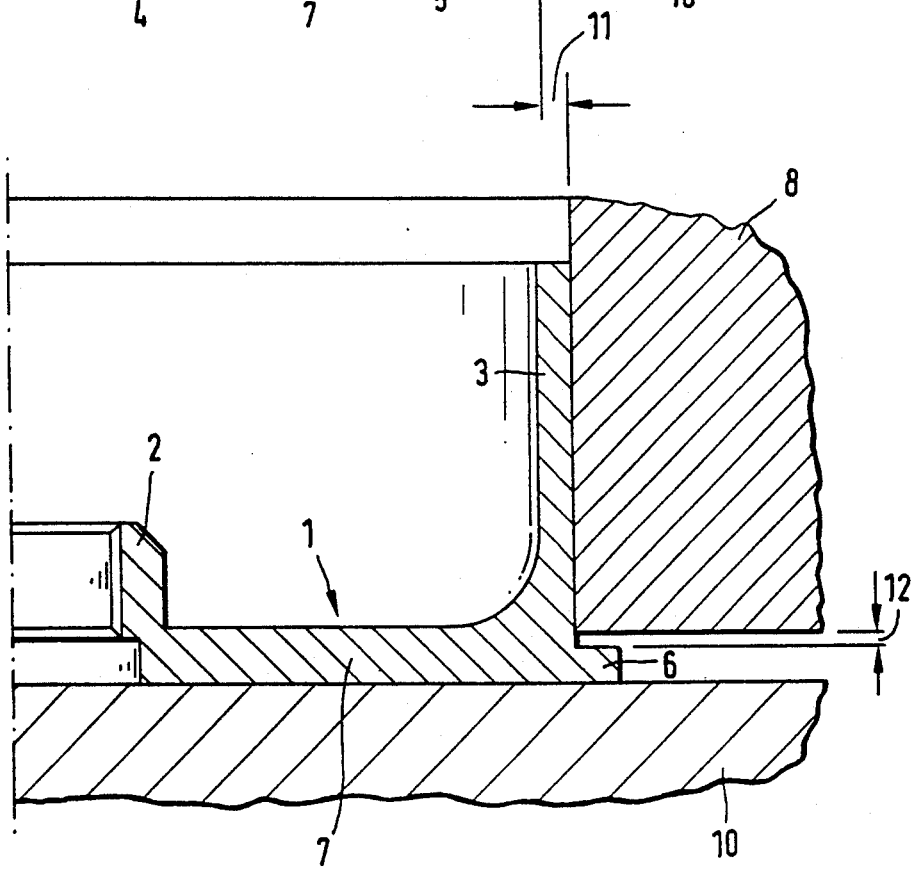
FIG. 2 shows the maximum deformation of the casing bottom of FIG. 1 upon firing.

During firing, the casing bottom is deformed as a result of the high gas pressure developed in the propelling charge casing, so that base plate 1 is pressed increasingly axially against the direction of its curvature in region 7 until the base plate 1 is finally pressed flat against breechblock wedge 10 as shown in FIG. 2. This also causes the cylindrical section 3 of the casing bottom to come into early engagement with the interior surface of gun barrel 8 so that no play 9 exists any longer and gun barrel 8 is then widened under the increasing gas pressure. That is, the casing bottom extends its radius by an amount 11 to a diameter that is greater than the caliber of the gun and, due to the straightening of the curvature, comes into complete contact with breechblock wedge 10 which, together with the casing bottom, is moved backward under the gas pressure by a small amount 12 of, for example, 2 mm relative to the rear end of the gun barrel 8. Because of the complete radial support of the casing bottom at the inner wall of the gun barrel, gas tightness is ensured during firing. The straightening of the curved region 7 of base plate 1 is coupled with a radial and tangential displacement of material that is connected with a build-up of radial and tangential compressive strain components.

The invention now being fully described, it will be apparent to one of ordinary skill in the art that any changes and modifications can be made thereto without departing from the spirit or scope of the invention as set forth herein.

What is claimed is:

1. A casing bottom for a propelling charge casing, said casing bottom comprising:

a circular ring-shaped base plate formed of metal and having an exterior and an interior face, said base plate being provided with a centrally arranged primer sleeve, for accommodating a primer element, and with a cylindrical section at an outer edge thereof, with said sleeve and said cylindrical section being formed of metal and in one piece with said base plate;

wherein the exterior face of said base plate is inwardly curved in an annular region of said base plate which is concentric with and around said sleeve and which is disposed between and extends from first and second planar annular portions of said exterior face; and wherein the interior face of said base plate is planar in said annular region.

2. A stub casing for a propelling charge casing, said stub casing comprising:

a circular ring shaped base plate provided with a centrally arranged axially extending primer sleeve, for accommodating a primer element, and with a cylindrical section extending concentric with said sleeve adjacent an outer edge of said baseplate, said sleeve and said baseplate and said cylindrical section being formed of meal and in one piece;

wherein said base plate has a planar exterior surface with an inwardly curved continuous annular region which extends from said planar surface concentric with and laterally spaced along said surface from said sleeve and from said cylindrical section, and which is closed to an interior surface of said base plate; and wherein said interior surface of said base plate is planar in said annular region.

* * * * *